US007507147B2

(12) United States Patent
Reim et al.

(10) Patent No.: US 7,507,147 B2
(45) Date of Patent: Mar. 24, 2009

(54) METHOD FOR MACHINING ROTARY PARTS

(75) Inventors: Peter Reim, Cremlingen (DE); Werner Huettig, Wolfenbuettel (DE); August Baumann, Nordrach (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

(21) Appl. No.: 11/662,214

(22) PCT Filed: Sep. 1, 2005

(86) PCT No.: PCT/EP2005/009433

§ 371 (c)(1),
(2), (4) Date: Dec. 26, 2007

(87) PCT Pub. No.: WO2006/027161

PCT Pub. Date: Mar. 16, 2006

(65) Prior Publication Data

US 2008/0102736 A1 May 1, 2008

(30) Foreign Application Priority Data

Sep. 8, 2004 (DE) ..... 10 2004 043 404

(51) Int. Cl.
*B24B 1/00* (2006.01)

(52) U.S. Cl. ..... 451/49; 451/57; 451/71; 451/246; 409/132; 29/888.08

(58) Field of Classification Search ..... 451/49, 451/51, 57, 58, 61, 69, 71, 242, 246, 249, 451/251, 379, 399; 409/132; 29/888.08
See application file for complete search history.

(56) References Cited

U.S. PATENT DOCUMENTS

| | | | | | |
|---|---|---|---|---|---|
| 2,011,091 | A * | 8/1935 | Steinbauer | 451/437 |
| 3,646,708 | A * | 3/1972 | Jones | 451/72 |
| 4,269,551 | A * | 5/1981 | Kralowetz | 409/132 |
| 5,018,309 | A * | 5/1991 | Wyss | 451/178 |
| 5,131,143 | A * | 7/1992 | Kirchberger | 29/888.08 |
| 5,253,417 | A * | 10/1993 | Johnson | 29/888.08 |
| 5,259,156 | A * | 11/1993 | Ronen | 451/143 |
| 5,980,171 | A | 11/1999 | Shimomura | |
| 6,761,516 | B2 * | 7/2004 | Pham | 409/132 |
| 6,913,522 | B2 | 7/2005 | Junker | |
| 2004/0058624 | A1 | 3/2004 | Suzuki et al. | |
| 2004/0248502 | A1 | 12/2004 | Junker | |
| 2005/0239376 | A1 * | 10/2005 | Junker | 451/11 |

FOREIGN PATENT DOCUMENTS

| | | |
|---|---|---|
| DE | 43 29 610 | 3/1995 |
| WO | WO-03/022521 | 3/2003 |

* cited by examiner

*Primary Examiner*—Eileen P. Morgan
(74) *Attorney, Agent, or Firm*—Jordan and Hamburg LLP

(57) ABSTRACT

In a method for machining rotation pieces, including at least one working step, and wherein at least one surface of the workpiece which is clamped in the device is subjected to a grinding step, at least one front-sided boring is carried out in the workpiece in the same clamping device used for the grinding step. For example, during a grinding process, the workpiece can be clamped at least at both ends in a clamping apparatus, and for the boring process, the clamping apparatus can be released at least at one end and a chuck for a boring tool can be arranged there, which then performs the desired end-face boring.

18 Claims, 1 Drawing Sheet

METHOD FOR MACHINING ROTARY PARTS

BACKGROUND OF THE INVENTION

The present invention relates to a method for machining of rotary parts that includes at least one working step in which at least one surface of the workpiece clamped in an apparatus is ground.

In the automobile industry, the machining of rotary parts, for instance crankshafts or the like, is associated with high production complexity. As a rule all relevant surfaces of such a rotary part are subjected to at least one grinding step. Other work steps on the workpiece, such as, for example, adding an end-face bore, require high precision for rotary parts of this type, for instance crankshafts. Heretofore, adding such a bore has therefore taken place on a separate special-purpose machine. According to the prior art, a special-purpose machine, a discrete work sequence, and, associated with this, re-clamping of the workpiece, is thus necessary for such a work step. This leads to high capital and production costs.

The object of the present invention is to simplify a method for machining rotary parts of the type described in the foregoing for reducing production costs while attaining high process reliability and obtaining high-quality workpieces.

SUMMARY OF THE INVENTION

This object is attained using a method according to the invention for processing rotary parts of the type described in the foregoing, the method including grinding at least one surface of the workpiece while ends thereof are clamped in respective chucks, releasing the workpiece from a one of the chucks at one end area of the workpiece, and forming an end-face bore at the one end area by use of a boring tool while maintaining clamping at another end area of the workpiece, the boring tool being arranged in the released chuck. By virtue of a boring tool, at least one end-face bore is added to the workpiece clamped in for the grinding step in the same clamping apparatus. In accordance with the invention, it is thus no longer necessary to re-clamp the workpiece into a special-purpose machine provided for that purpose with its own work sequence. The boring, for example, adding an end-face of suitable bore to a rotary part, for instance a crankshaft flange, occurs in the same clamping apparatus. This can occur in a suitable clamping device. For example, during a grinding process, the workpiece can be clamped at least at both ends in a clamping apparatus, and for the boring process the clamping apparatus can be released at least at one end and a chuck for a boring tool can be arranged there, which then performs the desired end-face boring. Preferably at least one fine bore or precision bore is added to the end-face of the workpiece.

In accordance with one preferred further development of the invention, it can be provided that after releasing a clamping apparatus at least at one end of the clamping, additional guidance for the workpiece is created on it's a circumference thereof using a guide element suitable therefore, for example, a guiding steady. The grinding process undertaken on the workpiece in the clamping apparatus preferably includes at least one CBN grinding by means of a grinding wheel.

In the past, as a rule, production of crankshafts has been very complex regardless of performance class. For instance, inter alia, the fitted bearings for almost all crankshafts are turned and burnished by means of a separate machine and work sequence. In accordance with one further development of the invention, this turning and burnishing work sequence for the fitted bearing can be omitted and can be replaced by grinding of the fitted bearing. For example, the fitted bearing can be ground in the flange/pin grinding operation, which always takes place. In this manner the production costs for producing such rotary parts, in particular crankshafts, can be reduced considerably.

According to the prior art, crankshafts typically undergo finish machining, regardless of the requirements for the crankshaft. This includes, for example, polishing of the main bearing, crank pin, flange, and pins on the crankshaft. In accordance with a further development of the invention, this polishing step can be omitted and can be replaced by a suitable grinding process, in particular CBN grinding. In this case, roughness can be attained, for example, on the order of magnitude of about 2 μm. Further fineness for $R_z$ can be attained in an optimizing process, for example, when problems occur in the area of an oil channel bore, a groove in the bearing, or the like. If the finish machining for the rotary part is omitted, especially in the case of crankshafts, this likewise leads to a further considerable reduction in production costs.

The subject-matter of the present invention is furthermore a rotary part, in particular a crankshaft, that is produced in accordance with a method of the type specified in the foregoing. Further advantages of the invention can be realized from the following detailed description.

The invention is described in greater detail in the following using exemplary embodiments and with respect to the attached drawings.

DETAILED DESCRIPTION OF THE INVENTION

Figure 1:
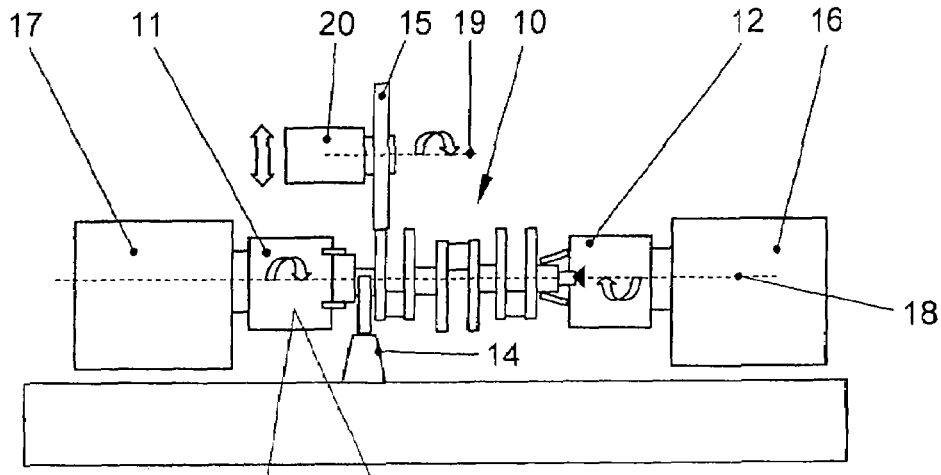
FIG. 1 is a schematic, simplified view of a crankshaft clamped in for various work steps.

Referring to FIG. 1, the drawing is a schematic, highly simplified depiction of a machine for machining rotary parts, in particular crankshafts. This machine includes a first drive unit 17 and a second drive unit 16 allowing the rotary part 10 to be machined from both ends. Moreover, a clamping apparatus is provided, including a first chuck 11 for clamping the rotary part 10 at one end thereof and a second chuck 12 for clamping the rotary part at another end thereof, the clamping apparatus being embodied such that the rotary part 10 can be rotated about its axis 18 by means of the drive units 16, 17. It can be useful to provide additional guide elements, for example, on the circumference for guiding the workpiece, especially when one side of one of the clamping apparatuses is released in order to perform a boring procedure in the end-face area. For this, the inventive machine has a guiding steady 14 that provides guidance and support on the circumference of the workpiece.

FIG. 1 illustrates the crankshaft 10 clamped for a grinding process and clamped at both ends using the chuck 11, 12. For the grinding process, a grinding wheel 15 can, for example, be used that can be rotatably driven about an axis 19 and that can be advanced in the direction toward the workpiece 10 by means of an appropriate apparatus 20 (see double-headed arrow in FIG. 1).

Figure 2:
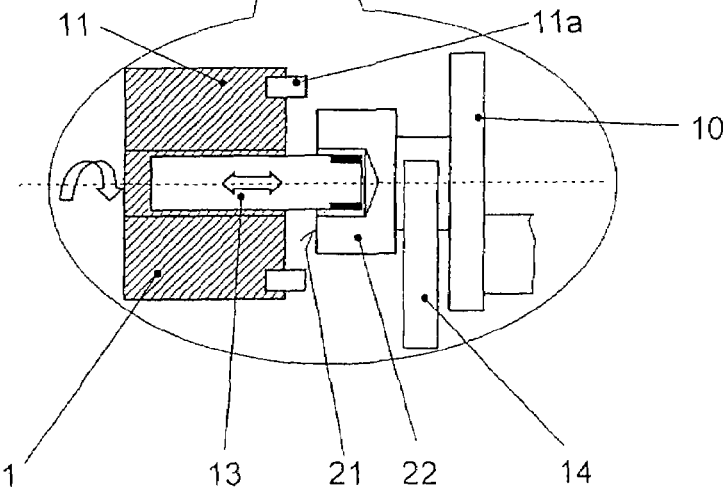
FIG. 2 is an enlarged detailed view of a portion 11 of FIG. 1.

Referring now to FIG. 2, the machining of the workpiece 10 from the end-face shall be explained in greater detail. FIG. 2 depicts an enlarged detail from the left-hand end area of the crankshaft 10. It is evident that the chuck 11 was withdrawn, the clamping elements 11*a* being released, so that there is no longer the original clamping at the left-hand end of the crankshaft 10 in the drawing. It can also be seen in a comparison with FIG. 1 that, due to the chuck 11 withdrawing, there is a certain distance between the chuck 11 and the end-face surface 21 of the crankshaft. Only one tool, for example, a fine-bore tool 13, can be clamped into the chuck 11 specially embodied therefore, and which adds an end-face precision bore to the flange 22 of the crankshaft 10. Since the clamping was released, the guide steady 14 now supports the crankshaft 10 in this end area. The other end area of the crankshaft 10 remains clamped in the second chuck 12 as illustrated in FIG. 1, even during machining with the fine-bore tool 13. In the position in which the crankshaft 10 is clamped as illustrated in FIG. 2, the boring can be performed simply by advancing the fine-bore tool 13. After the bore has been added to the end-face surface 21 of the flange 22 of the crankshaft 10, the fine-bore tool is withdrawn, it is removed from the chuck 11, and if necessary, the crankshaft 10 can be re-clamped using the clamping elements 11*a* for further machining processes, for example, grinding of the surface or the like. The advantage of the inventive method is thus that work steps on the surface, such as grinding and boring processed in the end-face area, can take place on the same machine, in principle, in the same clamping.

LEGEND

10 Tool
11 Clamping apparatus
11*a* Clamping elements
12 Clamping apparatus
13 Boring tool
14 Guide element
15 Grinding wheel
16 Drive unit
17 Drive unit
18 Axis
19 Axis
20 Apparatus
21 End-face surface
22 Flange

The invention claimed is:

1. A method for machining a rotary part, comprising:

grinding at least one surface of the workpiece while ends thereof are clamped in respective chucks of an apparatus;

releasing said workpiece from a one of said chucks at one end area of said workpiece; and forming an end-face bore at said one end area by use of a boring tool while maintaining clamping at an other end area of said workpiece, said boring tool being arranged in said one of said chucks which was released.

2. A method according to claim 1, wherein said grinding includes at least one CBN grinding using a grinding wheel.

3. A method according to claim 1, wherein said end-face bore includes at least one fine bore or precision bore.

4. A method according to claim 1, further comprising providing additional guidance for said workpiece on a circumference thereof using a guide element, at least after the release of said one of said chucks.

5. A method according to claim 4, wherein said guide element includes a guiding steady.

6. A method according to claim 1, wherein said rotary part is a crankshaft.

7. A method according to claim 4, wherein said rotary part is a crankshaft.

8. A method according to claim 6, wherein said end-face bore includes an end-face suitable bore formed in a crankshaft flange of the crankshaft.

9. A method according to claim 1, wherein the grinding includes finish grinding which leaves a certain roughness without subsequent finish machining.

10. A method according to claim 2, wherein the grinding includes finish grinding which leaves a certain roughness without subsequent finish machining.

11. A method according to claim 9, wherein subsequent polishing of said workpiece following the finish grinding is not provided.

12. A method according to claim 10, wherein subsequent polishing of said workpiece following the finish grinding is not provided.

13. A method according to claim 6, wherein said grinding includes a machining of fitted bearings of said crankshaft carried out in said apparatus used for said grinding and forming.

14. A method according to claim 13, wherein the grinding further includes grinding of flanges and/or pins of said crankshaft which is carried out contemporaneously with said machining of said fitted bearings.

15. A method according to claim 13, wherein the grinding of said fitted bearing occurs without prior burnishing.

16. A method according to claim 14, wherein the grinding of said fitted bearings occurs without prior burnishing.

17. A method according to claim 1, wherein all surfaces of a crankshaft to be ground or formed are machined in said apparatus used for said grinding and forming.

18. A method according to claim 17, wherein all surfaces of a crankshaft to be ground or formed are machined in one clamping.

* * * * *